US011060390B2

(12) United States Patent
Fitzsimmons et al.

(10) Patent No.: US 11,060,390 B2
(45) Date of Patent: Jul. 13, 2021

(54) MITIGATION OF FRICTIONAL HEAT CHECKING IN WELL CASING

(71) Applicant: Chevron U.S.A. Inc., San Ramon, CA (US)

(72) Inventors: Michael Ryan Fitzsimmons, Katy, TX (US); Rollyn Rousel Samson Reyes, Houston, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 16/824,059

(22) Filed: Mar. 19, 2020

(65) Prior Publication Data

US 2021/0131279 A1 May 6, 2021

Related U.S. Application Data

(60) Provisional application No. 62/928,797, filed on Oct. 31, 2019.

(51) Int. Cl.

| | |
|---|---|
| ***E21B 44/00*** | (2006.01) |
| ***E21B 45/00*** | (2006.01) |
| ***E21B 49/00*** | (2006.01) |
| ***E21B 47/007*** | (2012.01) |

(52) U.S. Cl.
CPC ..... *E21B 44/00* (2013.01); *E21B 45/00* (2013.01); *E21B 47/007* (2020.05); *E21B 49/003* (2013.01)

(58) Field of Classification Search
CPC ..... E21B 47/00; E21B 47/007; E21B 49/003; E21B 44/00; E21B 45/00
See application file for complete search history.

(56) References Cited

U.S. PATENT DOCUMENTS

| | | | | |
|---|---|---|---|---|
| 3,682,256 | A * | 8/1972 | Stuart | E21B 47/00 175/40 |
| 9,976,416 | B2 * | 5/2018 | Samuel | E21B 47/00 |
| 10,487,640 | B2 * | 11/2019 | Aniket | G06N 20/00 |
| 10,961,786 | B2 * | 3/2021 | Samuel | E21B 12/02 |

OTHER PUBLICATIONS

Eaton, L. F. (1993, Tool Joint Heat Checking While Predrilling for Auger TLP Project, SPE/IADC Drilling Conference, Amsterdam, The Netherlands).

* cited by examiner

*Primary Examiner* — D. Andrews
(74) *Attorney, Agent, or Firm* — Esplin & Associates, PC

(57) ABSTRACT

Downhole casing temperature may be predicated at the drill string/casing interface as a function of side force on the casing due to drill string tension, the speed or rate of penetration of the drill string in the axial direction, the rate of rotation of the drill string, and a calibrated/assumed friction factor. Predicted down hole casing temperature may be used as a proxy to monitor casing integrity.

20 Claims, 6 Drawing Sheets

300

MITIGATION OF FRICTIONAL HEAT CHECKING IN WELL CASING

CROSS-REFERENCE TO RELATED APPLICATION

The present application claims the benefit of U.S. Provisional Application No. 62/928,797, entitled "Methods of Mitigating Frictional Heat Check in Offshore Deepwater Well Casing," which was filed on Oct. 31, 2019, the entirety of which is hereby incorporated herein by reference.

FIELD

The present disclosure relates generally to the field of monitoring integrity of casings based on estimated temperature of the casings during drilling operations.

BACKGROUND

Heat checking and subsequent fracture propagation in well casings may result in casing leaks and/or failure. Remediating such well casings may be both time-consuming and expensive and/or result in loss of the well.

SUMMARY

This disclosure relates to monitoring casings. Operating information for a drilling operation, side-force information for the drilling operation, and/or other information may be obtained. The operating information may characterize a penetration rate and a rotation rate of a drilling tool moving through a casing in a borehole. The side-force information may characterize side-force between the casing and the drilling tool. Temperature of the casing during the drilling operation may be estimated based on the penetration rate of the drilling tool, the rotation rate of the drilling tool, the side-force between the casing and the drilling tool, and/or other information. Integrity of the casing may be monitored based on the estimated temperature of the casing during the drilling operation and/or other information.

A system that monitors casings may include one or more electronic storage, one or more processors and/or other components. The electronic storage may store operating information, side-force information, information relating to a drilling operation, information relating to a drilling tool, information relating to penetration rate of a drilling tool, information relating to a rotation rate of a drilling tool, information relating to a casing, information relating to a borehole, information relating to side-force between a casing and a drilling tool, information relating to temperature of a casing, information relating to integrity of a casing, and/or other information.

The processor(s) may be configured by machine-readable instructions. Executing the machine-readable instructions may cause the processor(s) to facilitate monitoring casings. The machine-readable instructions may include one or more computer program components. The computer program components may include one or more of an operating information component, a side-force information component, a temperature component, an integrity component, and/or other computer program components.

The operating information component may be configured to obtain operating information for a drilling operation and/or other information. The operating information may characterize a penetration rate of a drilling tool, a rotation rate of the drilling tool, and/or other information relating to operation of the drilling tool. The drilling tool may be move through a casing in a borehole.

The side-force information component may be configured to obtain side-force information for the drilling operation and/or other information. The side-force information may characterize side-force between the casing and the drilling tool and/or other interaction between the casing and the drilling tool. In some implementations, the drilling tool may include a drill pipe, and contact between the casing and the drill pipe may cause the side-force between the casing and the drill pipe. In some implementations, the contact between the casing and the drill pipe may include contact between the casing and a joint of the drill pipe, contact between the casing and a tube of the drill pipe, and/or other contact between the casing and the drilling pipe.

The temperature component may be configured to estimate temperature of the casing during the drilling operation. The temperature of the casing may be estimated based on the penetration rate of the drilling tool, the rotation rate of the drilling tool, the side-force between the casing and the drilling tool, and/or other information.

The integrity component may be configured to monitor integrity of the casing. The integrity of the casing may be monitored based on the estimated temperature of the casing during the drilling operation and/or other information. In some implementations, monitoring the integrity of the casing based on the estimated temperature of the casing during the drilling operation may include determining whether the estimated temperature of the casing during the drilling operation is above or below steel austenitizing temperature.

In some implementations, monitoring the integrity of the casing based on the estimated temperature of the casing during the drilling operation may include determining a number of heat check cycle based on the estimated temperature of the casing during the drilling operation. The heat check cycle may quantify an extent to which the casing experienced above-austenitizing temperature during the drilling operation.

In some implementations, monitoring the integrity of the casing based on the estimated temperature of the casing during the drilling operation may further include providing a real-time monitoring interface that visually provides information on the number of heat check cycle. The real-time monitoring interface may include heat check cycle markers and/or other markers. The heat check cycle markers may visually represent individual occurrences of the casing experiencing the above-austenitizing temperature during the drilling operation. The real-time monitoring interface may further include a cumulative indicator and/or other indicators. The cumulative indicator may visually represent accumulation of the occurrences of the casing experiencing the above-austenitizing temperature during the drilling operation. In some implementations, the real-time monitoring interface may visually provide information on the estimated temperature of the casing, steel austenitizing temperature, and/or side force.

These and other objects, features, and characteristics of the system and/or method disclosed herein, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a," "an," and "the" include plural referents unless the context clearly dictates otherwise.

DETAILED DESCRIPTION

The present disclosure relates to monitoring casings. Downhole casing temperature may be predicated at the drill string/casing interface as a function of side force on the casing due to drill string tension, the speed or rate of penetration of the drill string in the axial direction, the rate of rotation of the drill string, and a calibrated/assumed friction factor. Predicted down hole casing temperature may be used as a proxy to monitor casing integrity.

Figure 1:
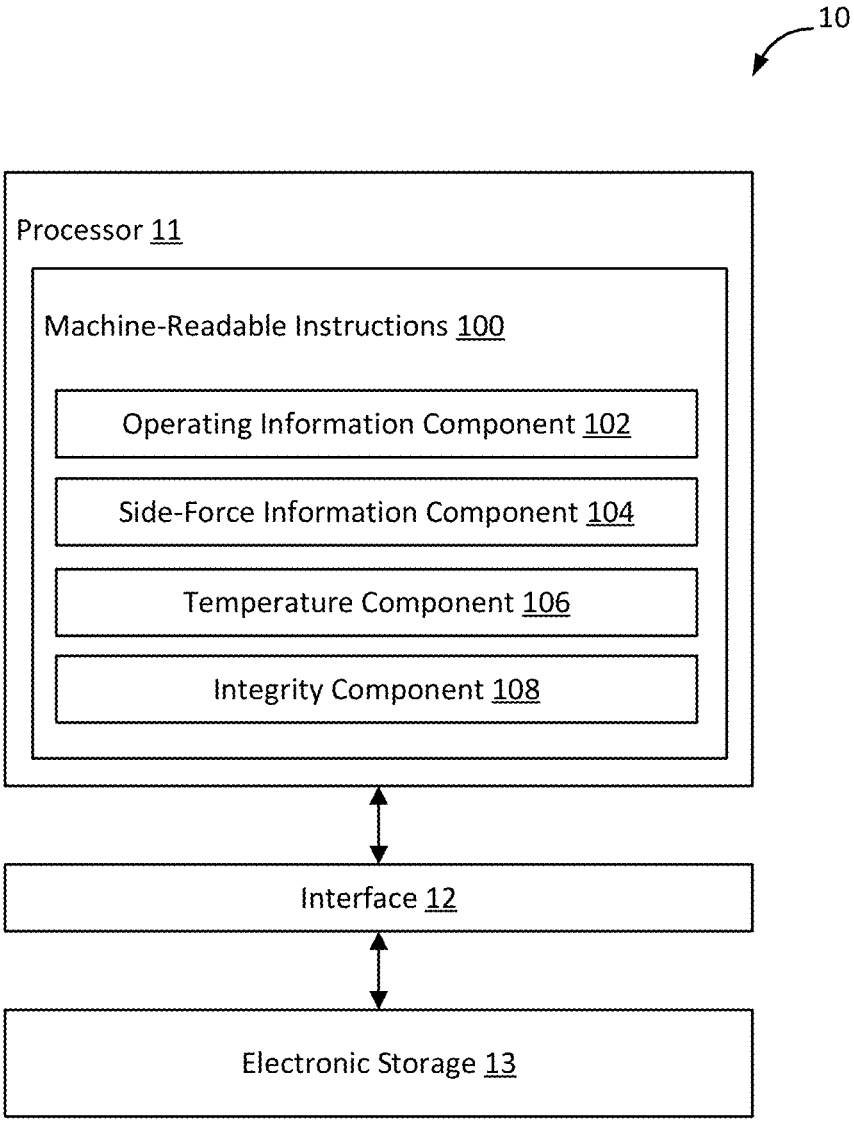
FIG. 1 illustrates an example system that monitors casings.

The methods and systems of the present disclosure may be implemented by and/or in a computing system, such as a system 10 shown in FIG. 1. The system 10 may include one or more of a processor 11, an interface 12 (e.g., bus, wireless interface), an electronic storage 13, and/or other components. Operating information for a drilling operation, side-force information for the drilling operation, and/or other information may be obtained by the processor 11. The operating information may characterize a penetration rate and a rotation rate of a drilling tool moving through a casing in a borehole. The side-force information may characterize side-force between the casing and the drilling tool. Temperature of the casing during the drilling operation may be estimated by the processor 11 based on the penetration rate of the drilling tool, the rotation rate of the drilling tool, the side-force between the casing and the drilling tool, and/or other information. Integrity of the casing may be monitored by the processor 11 based on the estimated temperature of the casing during the drilling operation and/or other information.

A borehole may refer to a hole, a tunnel, or a shaft drilled in the ground. A borehole may be drilled in the ground for exploration and/or recovery of natural resources in the ground. For example, a borehole may be drilled in the ground to aid in extraction of petrochemical fluid (e.g., oil, gas, petroleum, fossil fuel). A borehole may be drilled in one or more directions. For example, a borehole may include a vertical borehole, a horizontal borehole, a deviated borehole, and/or other type of borehole.

A casing may refer to a pipe that is inserted into a borehole. The casing may be cemented within the borehole to stabilize the borehole. The casing may prevent surrounding formation wall from casing into the borehole, isolate different formation to prevent flow and/or crossflow of formation fluid, and/or provide a way to maintain control of formation fluids and/or pressure as the borehole (e.g., lower portion of the borehole) is drilled. Maintaining integrity of the casing may be important to stability of the borehole, drilling of the borehole, and/or to other borehole operations. Damage to the casing may result in leaks in casing and/or parted casing, which may result in downtimes and costly remediation expenditures.

For example, tapered drill strings required to reach depths greater than 30,000 feet true vertical depth in deep water wells may result in high side forces from shallow doglegs, which may magnify the propensity for drill string induced casing damage. Contact between the drilling string and the casing may result in heat checking. Heat checking may refer to damage to a structure caused by frictional heating followed by cooling of the structure. Heat checking may occur in one or more components inside a borehole. For example, heat checking may refer to cracks on a casing caused by rapid frictional heating caused by contact between the casing and the drill string, followed by rapid quench cooling of the casing. Drilling string contact against the casing (e.g., contact between joint and/or tube of a drill pipe) under certain conditions (e.g., high side load, high revolutions per minute (RPM), low rate of penetration (ROP)) may generate enough heat for the casing to reach steel austenitizing temperature. When drilling fluid reaches the heated region, the contact points may rapidly cool, transforming the microstructure of the casing and resulting in localized brittle areas and cracking. For example, a thin (~0.005"), hard, un-tempered martensite zone may be formed on the casing, and this zone may be prone to longitudinal fracturing under tensile stress. Fractures originating in this zone may propagate radially into the casing wall, potentially leading to through wall failure.

The electronic storage 13 may be configured to include electronic storage medium that electronically stores information. The electronic storage 13 may store software algorithms, information determined by the processor 11, information received remotely, and/or other information that enables the system 10 to function properly. For example, the electronic storage 13 may store operating information, side-force information, information relating to a drilling operation, information relating to a drilling tool, information relating to penetration rate of a drilling tool, information relating to a rotation rate of a drilling tool, information relating to a casing, information relating to a borehole, information relating to side-force between a casing and a drilling tool, information relating to temperature of a casing, information relating to integrity of a casing, and/or other information.

The processor 11 may be configured to provide information processing capabilities in the system 10. As such, the processor 11 may comprise one or more of a digital processor, an analog processor, a digital circuit designed to process information, a central processing unit, a graphics processing unit, a microcontroller, an analog circuit designed to process information, a state machine, and/or other mechanisms for electronically processing information. The processor 11 may be configured to execute one or more machine-readable instructions 100 to facilitate monitoring casings. The machine-readable instructions 100 may include one or more computer program components. The machine-readable instructions 100 may include one or more of an operating information component 102, a side-force information component 104, a temperature component 106, an integrity component 108, and/or other computer program components.

The operating information component 102 may be configured to obtain operating information for a drilling operation and/or other information. Obtaining operating information may include one or more of accessing, acquiring, analyzing, determining, examining, identifying, loading, locating, opening, receiving, retrieving, reviewing, selecting, storing, utilizing, and/or otherwise obtaining the operating information. The operating information component 102 may be configured to obtain the operating information from one or more locations. For example, the operating information component 102 may obtain operating information from a storage location, such as the electronic storage 13, electronic storage of a device accessible via a network, and/or other locations. The operating information component 102 may obtain operating information from one or more hardware components (e.g., a computing device, a component of a computing device, a sensor, a component of a drilling tool) and/or one or more software components (e.g., software running on a computing device). The operating information component 102 may be configured to obtain the operating information during the drilling operation. The operation information may be obtained as real-time data of the drilling operation. The operation information may be stored within a single file or multiple files.

The operating information may characterize one or more operating values of the drilling operation. A drilling operation may refer to a performance of work and/or activity to drill one or more holes, such as one or more boreholes into the ground. A drilling operation may include passage of a drilling tool through a casing in the borehole to perform further drilling of the borehole. That is, the drilling tool may be move through a casing in a borehole to drill portions of the ground beyond the casing. A drilling tool may refer to a device or an implement designed and/or used for drilling. A drilling tool may be designed and/or used to drill one or more substances. For example, a drilling tool may include a rock drilling tool for drilling into and/or through rock (e.g., sedimentary rock). A drilling tool to may refer to one or more portions of a device/implement that performs the drilling. A drilling tool may refer to portions of or entirety of a device/implement that performs drilling. For example, a drilling tool may refer to one or more portions of a drill string (e.g., drill pipe) and/or the entirety of the drill string. Other drilling tools are contemplated.

Operating values of a drilling operation may refer to values (e.g., discrete values, continuous values, categorical values) of one or more parameters/parameter values of the drilling tool(s) used for the drilling operation. Operating values of a drilling operation may be recorded/determined during the drilling operation. For example, operating values of a drilling operation may include parameter(s)/parameter value(s) of the drilling tool(s) that are controlled and/or set to operate the drilling tool(s) in a particular manner and perform the drilling operation. Operating values of a drilling operation may include parameter(s)/parameter value(s) of the drilling tool(s) that indicate how the drilling tool(s) are used during the drilling operation. Operating values of a drilling operation may include one or more values of environmental condition(s) of and/or near the drilling tool(s). For example, operating values of a drilling operation may include parameters/parameter values of a drilling tool, such as a penetration rate of the drilling tool, a rotation rate of the drilling tool, and/or other information relating to the operation of the drilling tool and/or drilling operation.

The operating information may characterize operating values of a drilling operation by including information that characterizes (e.g., reflects, quantifies, identifies, defines) one or more values, qualities, attributes, features, and/or other aspects of the operating values. For example, the operating information may characterize operating values of a drilling operating information by including information that makes up and/or is used to determine values, characters, and/or symbols of the operating values. For instance, the operating information may include time-indexed drilling tool sensor data reflecting the penetration rate of the drilling tool, the rotation rate of the drilling tool, and/or other operation of the drilling tool. Other types of operating information are contemplated.

The side-force information component 104 may be configured to obtain side-force information for the drilling operation and/or other information. Obtaining side-force information may include one or more of accessing, acquiring, analyzing, determining, examining, identifying, loading, locating, opening, receiving, retrieving, reviewing, selecting, storing, utilizing, and/or otherwise obtaining the side-force information. The side-force information component 104 may be configured to obtain the side-force information from one or more locations. For example, the side-force information component 104 may obtain side-force information from a storage location, such as the electronic storage 13, electronic storage of a device accessible via a network, and/or other locations. The side-force information component 104 may obtain side-force information from one or more hardware components (e.g., a computing device, a component of a computing device, a sensor, a component of a drilling tool) and/or one or more software components (e.g., software running on a computing device). The side-force information may be stored within a single file or multiple files.

The side-force information component 104 may be configured to obtain the side-force information before and/or during the drilling operation. In some implementations, the side-force information may be obtained as prediction/estimation of side-force between the casing and the drilling tool during the drilling operation. For example, side-force information may include information extracted from and/or determined from historical, survey, and/or simulated drilling data for same/similar drilling operation (e.g., historical, survey, and/or simulated drilling data for drilling under same/similar condition, historical, survey, and/or simulated drilling data for drilling operation using same/similar drilling tool and/or casing). As another example, side-force information may include information on expected conditions of the drilling operations (e.g., expected interaction/contact between the drilling tool and the casing, survey data) from which side-force between the casing and the drilling tool during the drilling operation may be predicted/estimated. That is, the side-force information may be interpreted to determine (e.g., predict, estimate) the side-force between the casing and the drilling tool.

In some implementations, the side-force information may be obtained as real-time data of the drilling operation. The side-force information may be obtained based on sensor readings of the conditions during drilling operations. For example, the side-force information may include information extracted from and/or determined based on sensor readings of the interaction/contact between the drilling tool and the casing during the drilling operation. The side-force information may be interpreted to determine the actual side-force between the casing and the drilling tool during the drilling operation.

The side-force information may characterize side-force between the casing and the drilling tool and/or other interaction between the casing and the drilling tool. Side-force may refer to force produced by interaction between the casing and the drilling tool. Side-force may refer to load (side-load) experienced by the casing and/or the drilling tool due to the interaction between the casing and the drilling tool. For example, the drilling tool may include a drill pipe, and side-force may refer to force caused by the contact between the casing and the drill pipe during the drilling operation. The contact between the casing and the drill pipe may include contact between the casing and one or more joints of the drill pipe, contact between the casing and one or more tubes of the drill pipe, and/or other contact between the casing and the drilling pipe. The amount/value of side-force may change during the drilling operation, such as based on the drilling pipe and the casing contacting differently during the drilling operation.

The side-force information may characterize side-force between the casing and the drilling tool by including information that that characterizes (e.g., reflects, quantifies, identifies, defines) one or more values, qualities, attributes, features, and/or other aspects of the side-force between the casing and the drilling tool. For example, the side-force information may characterize side-force between the casing and the drilling tool by including information that makes up and/or is used to determine values and/or attributes of the side force. For instance, the side-force information may include information that makes up and/or is used to determine casing curvature, drill string tension, and/or other information to determine the side-force. Side-force may be a modeled variable based on the casing curvature, drill string tension, and/or other information. Other types of side-force information are contemplated.

The temperature component 106 may be configured to estimate temperature of the casing during the drilling operation. Estimating temperature of the casing may include calculating, determining, and/or otherwise estimating the temperature of the casing. Estimated temperature of the casing may include approximate and/or rough value of the temperature the casing. The temperature of the casing may be estimated based on the operating information, the side-force information, and/or other information. The temperature of the casing may be estimated based on one or more operating values of the drilling operation, interaction between the casing and the drilling tool, and/or other information. For example, the temperature of the casing may be estimated based on the penetration rate (e.g., ROP) of the drilling tool, the rotation rate (e.g., RPM) of the drilling tool, the side-force between the casing and the drilling tool, and/or other information. For instance, the temperature of the casing may be estimated as a function of the values of the penetration rate of the drill string, the rotation rate of the drill string, and the side-force between the casing and the drill string.

Figure 3:
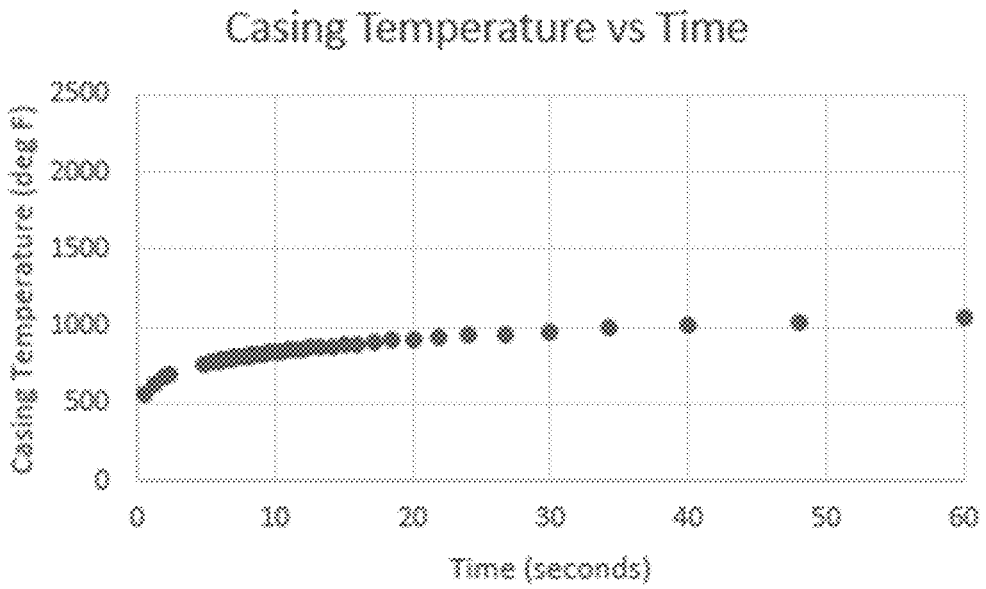
FIG. 3 illustrates an example non-linear relationship between drill string induced casing temperature versus time.

In some implementations, the temperature of the casing may be estimated based on a three-dimensional static finite element analysis model. The three-dimensional static finite element analysis model may facilitate approximation of drilling conditions (e.g., ROP, RPM, side-force) that have the potential to cause casing temperature to raise above steel austenitizing temperature and cause heat checking. FIG. 3 illustrates an example plot 300 of casing temperature versus time, with the temperature being calculated based on frictional energy due to drill pipe rotation and side load. The plot 300 may have been generated using the three-dimensional static finite element analysis model with no pipe rotation, no transverse pipe movement, and no fluid flow to better quantify heat loss (pure conduction) through the casing, drill pipe, and surrounding drilling fluid. The plot 300 may exhibit a non-linear relationship between drill string induced casing temperature and time. Such model may provide more accurate estimation of the casing temperature than a model that utilizes a linear relationship between drill string induced casing temperature and time.

Figure 4:
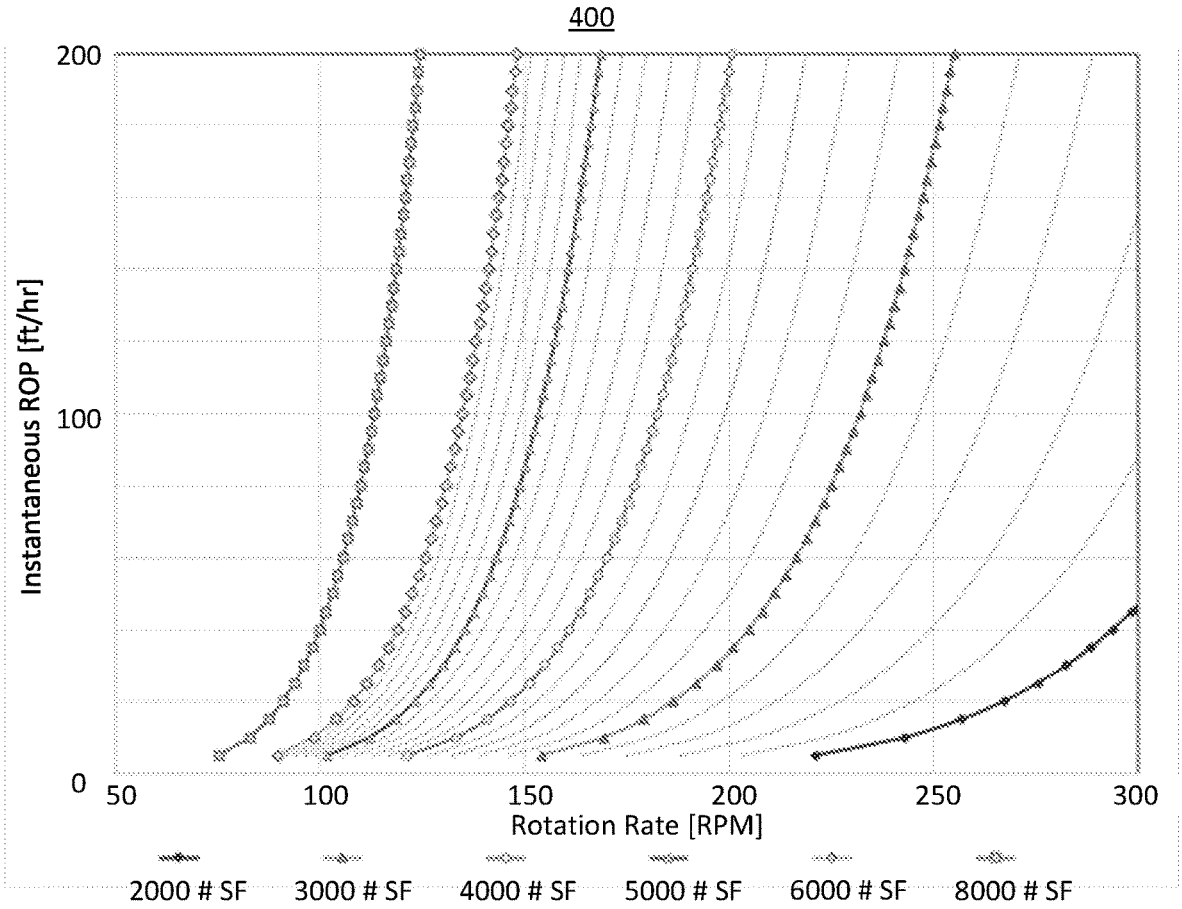
FIG. 4 illustrates an example heat checking drilling parameter window.

FIG. 4 illustrates an example heat checking drilling parameter window 400. The heat checking drilling parameter window 400 may include example curves showing relationship between penetration rate, rotation rate, side-force (SF) and casing austenitizing temperature. The curves may be constructed based on the three-dimensional static finite element analysis model. Within the heat checking drilling parameter window 400, values of penetration rate and values of rotation rate combination that land to the left and above the corresponding side-force line may represent a casing temperature that is less than the casing austenitizing temperature. Values of penetration rate and values of rotation rate combination that land to the right and below the corresponding side-force line may represent a casing temperature that is more than the casing austenitizing temperature The integrity component 108 may be configured to monitor integrity of the casing. Integrity of the casing may refer to condition, quality, and/or state of the casing. Integrity of the casing may refer to condition, quality, and/or state of the structure of the casing. Maintaining the integrity of the casing may be important to usage of the casing. The integrity of the casing may be monitored based on the estimated temperature of the casing during the drilling operation and/or other information. The estimated temperature of the causing during the drilling operation may be used to determine whether or not the casing experienced heat checking and/or to determine the extent of heat checking experienced by the casing during the drilling operation. Monitoring the integrity of the casing based on the estimated temperature of the casing during the drilling operation may include determining whether the estimated temperature of the casing during the drilling operation goes above or below steel austenitizing temperature. Monitoring the integrity of the casing based on the estimated temperature of the casing during the drilling operation may include determining when and/or to what extent (e.g., duration) the estimated temperature of the casing during the drilling operation exceeded steel austenitizing temperature. Monitoring the integrity of the casing based on the estimated temperature of the casing during the drilling operation may include determining under what drilling operation condition (e.g., under what penetration rate, rotation rate, side-force) the estimated temperature of the casing during the drilling operation exceeded steel austenitizing temperature.

In some implementations, monitoring the integrity of the casing based on the estimated temperature of the casing during the drilling operation may include determining a number of heat check cycle based on the estimated temperature of the casing during the drilling operation and/or other information. The number of heat check cycle may provide a way to quantify the relative probability of the drilling tool contacting the casing. For example, contact between the joints of the drill pipe and the casing may be assumed to be the primary cause of heat checking. The exact location of a joint relative to a particular location (e.g., depth of interest) may be unknown on a real-time basis, and the number (cycle count) of heat check cycle may provide a way to quantify the relative probability of a true physical tool joint to casing contact at a single location. Instantaneous RPM and ROP data, along with modeled side forces, may be processed to predict casing temperature at particular locations, and the length of drilling (e.g., footage drilled) above austenitizing temperature may be calculated and added in a cumulative fashion to serve as a proxy for the number of joints that may have induced temperature above austenitizing temperature at a casing depth of interest. For instance, one cycle of a heat check cycle may correspond to the length of one joint of the drill pipe.

A heat check cycle may quantify an extent to which the casing experienced above-austenitizing temperature (temperature exceeding steel austenitizing temperature) during the drilling operation. A heat check cycle may quantity risk (cumulative risk) of casing failure/damage in the form of cycle counts. A heat check cycle may quantity estimated damage (cumulative damage) to the casing based on the casing experienced above-austenitizing temperature during the drilling operation. For example, a certain number of heat check cycle may correspond to a certain percentage of casing failure and/or certain extent of casing damage. For instance, a casing that undergoes thirty heat check cycles may have a forty percent chance of failure. Other correspondence between number of heat check cycles with percentage of casing failure and/or extent of casing damage are contemplated.

In some implementations, monitoring the integrity of the casing based on the estimated temperature of the casing during the drilling operation may further include providing a real-time monitoring interface that visually provides information on the number of heat check cycle. The real-time monitoring interface may include one or more graphical user interfaces that include elements that represent information on the number of heat check cycle, information on the drilling operation, and/or other information.

Figure 5:
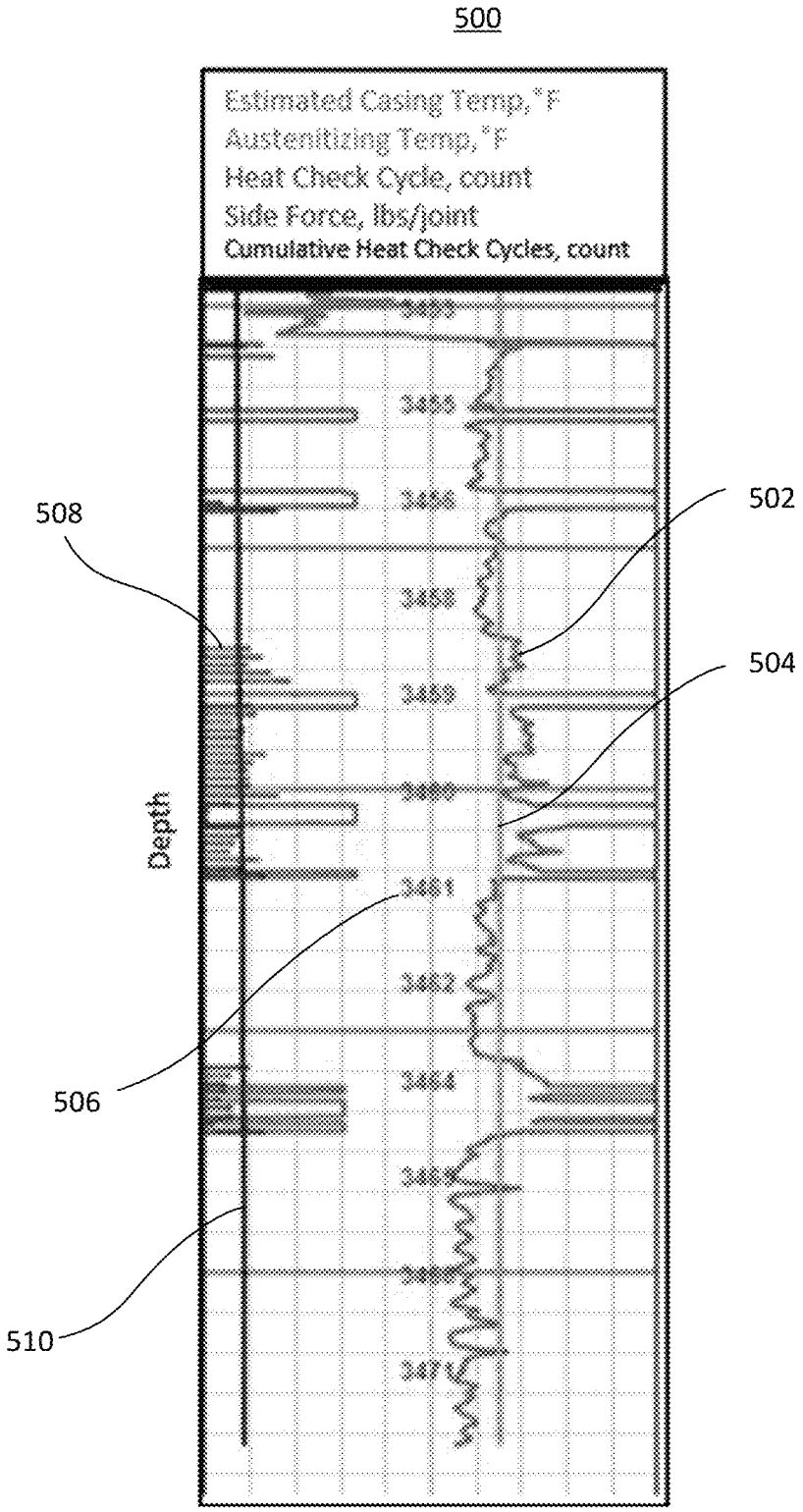
FIG. 5 illustrates an example real-time monitoring interface.

FIG. 5 illustrates an example real-time monitoring interface 500. The real-time monitoring interface 500 may visually provide information on the estimated temperature of the casing, steel austenitizing temperature, heat check cycle count, side force, cumulative heat check cycles, and/or other information. The real-time monitoring interface 500 may include a casing temperature line 502 representing estimated casing temperature (calculated instantaneous casing temperature), and an austenitizing temperature line 504 representing the casing austenitizing temperature. The numbers 506 running along the middle of the real-time monitoring interface 500 may represent estimated side force at different locations, such as at depths of interest.

The real-time monitoring interface 500 may include heat check cycle markers 508 and/or other markers. The heat check cycle markers 508 may visually represent individual occurrences of the casing experiencing the above-austenitizing temperature during the drilling operation. For example, the heat check cycle markers 508 may visually represent fractions of heat check cycles experienced by the casing during the drilling operation. The heat check cycle markers 508 may appear within the real-time monitoring interface 500 when the estimated casing temperature (line 502) exceeds the casing austenitizing temperature (line 504). The real-time monitoring interface 500 may further include a cumulative indicator 508 and/or other indicators. The cumulative indicator 508 may visually represent accumulation of the occurrences of the casing experiencing the above-austenitizing temperature during the drilling operation. For example, the fractions of heat check cycles documented by the heat check cycle markers 508 may be added in cumulative fashion to generate the cumulative indicator 508.

The real-time monitoring interface 500 may be provided as a real-time monitoring display of the drilling operation. The real-time monitoring interface 500 may be provided to facilitate monitoring of the drilling operation. For example, the number and/or the size of the heat check cycle markers 508 may be monitored to determine when and/or the extent to which the drilling operation is causing heat checking of the casing. The drilling operation may be modified to reduce/avoid heat checking. As another example, the cumulative indicator 508 may be monitored to determine how much heat checking was experience by the casing. The cumulative indicator 508 may be used to determine whether the drilling operation should be stopped, changed, and/or continued.

In some implementation, the provision of the real-time monitoring interface 500 may be accompanied by one or more alarms. For example, based on the number and/or the size of the heat check cycle markers 508, and/or the value of the cumulative indicator 508 (e.g., exceeding a threshold), one or more visual, audible, and/or haptic alarms may be generated to bring potentially damaging drilling operation to attention of users. In some implementation, the provision of the real-time monitoring interface 500 may be accompanied by automation. For example, based on the number and/or the size of the heat check cycle markers 508, and/or the value of the cumulative indicator 508 (e.g., exceeding a threshold), the drilling operation may be automatically stopped and/or modified to reduce the occurrence/extent of heat checking. In some implementations, the real-time monitoring interface may provide suggestions on how to perform the drilling operations. For example, based on the number and/or the size of the heat check cycle markers 508, and/or the value of the cumulative indicator 508 (e.g., exceeding a threshold), the real-time monitoring interface may provide one or more mitigation strategies on how to perform the drilling operation to reduce the occurrence of heat checking (e.g., by reducing rate of penetration, rate of rotation, etc.) and/or to maintain the integrity of the casing. Other usage of the real-time monitoring interface 500 are contemplated.

Figure 6:
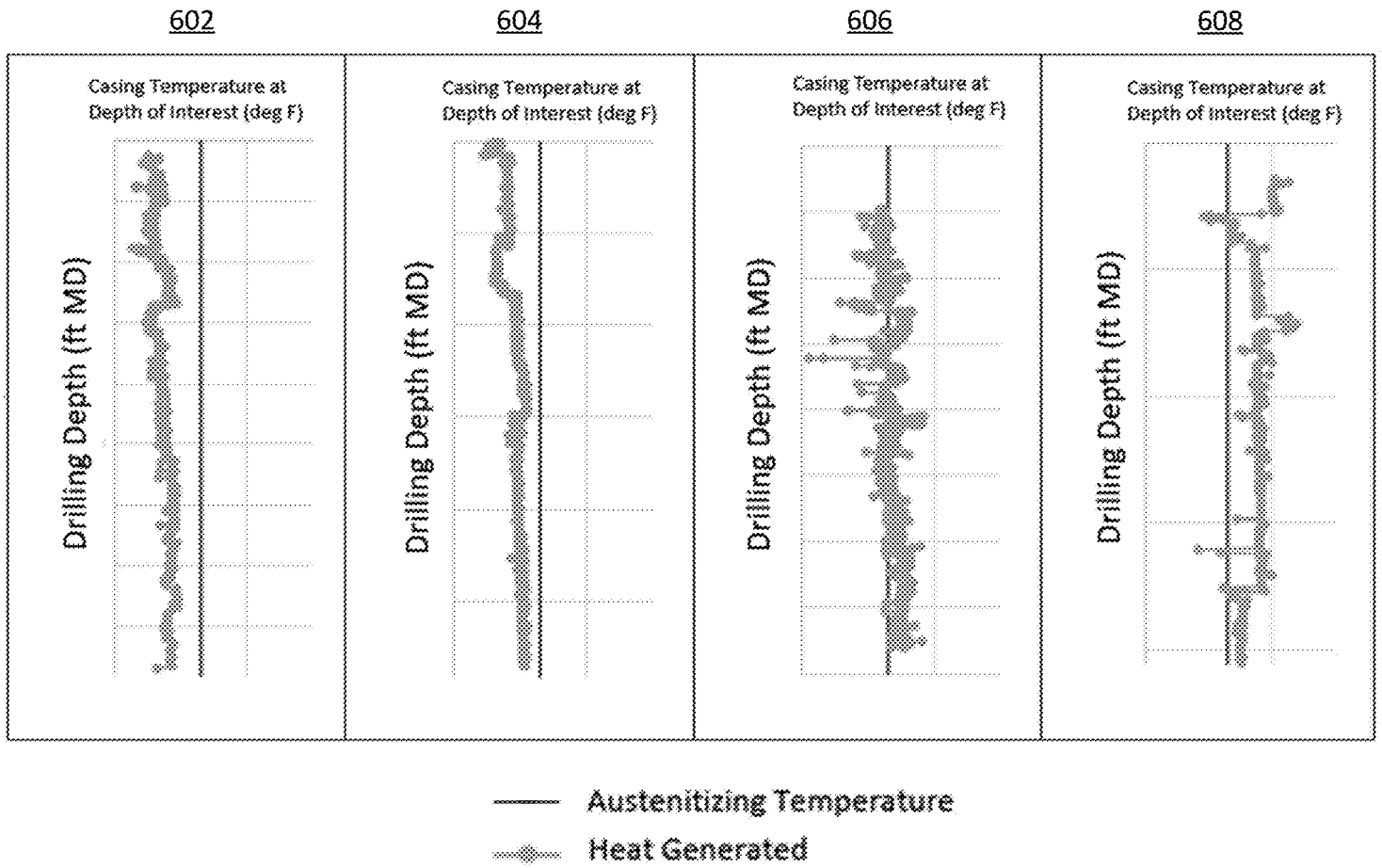
FIG. 6 illustrates example curves of estimated temperatures with respect to austenitizing temperature.

FIG. 6 illustrates example plots 602, 604, 606, 608 of estimated temperatures with respect to austenitizing temperature. The values of the casing temperature shown in FIG. 6 may be three-dimensional static finite element analysis drill string induced casing temperature. The time component of the three-dimensional static finite element analysis model may be converted to a rate of penetration term based on an assumed contact length between the drill pipe and casing, and the temperature curves may be generated for drilling operations. Based on penetration rate, rotation rate, and side force (e.g., calculated from torque, drag models, and/or friction factors), the values of the casing temperature may be estimated. The plots 602, 604, 606, 608 may show example output of the analysis showing casing temperature as a function of drilling depth for four drilling operations. The drilling operations for the plots 602, 604 may have resulted in the casing temperature being below casing austenitizing temperature. The drilling operations for the plots 606, 608 may have resulted in the casing temperature exceeding casing austenitizing temperature. The integrity of the casings for the plots 602, 604 may have been maintained during the drilling operation, leading to proper functioning of the casings (e.g., no leaks in the wells). The integrity of the casings for the plots 606, 608 may have been damaged during the drilling operation, leading to improper functioning of the casings (e.g., leaks in the wells). Strong correlation may exist between temperature of the casing exceeding casing austenitizing temperature and failure of the casing, and the real-time estimation of casing temperature may be used to monitor the integrity of the casing and/or mitigate potential/risk of heat checking.

Implementations of the disclosure may be made in hardware, firmware, software, or any suitable combination thereof. Aspects of the disclosure may be implemented as instructions stored on a machine-readable medium, which may be read and executed by one or more processors. A machine-readable medium may include any mechanism for storing or transmitting information in a form readable by a machine (e.g., a computing device). For example, a tangible computer-readable storage medium may include read-only memory, random access memory, magnetic disk storage media, optical storage media, flash memory devices, and others, and a machine-readable transmission media may include forms of propagated signals, such as carrier waves, infrared signals, digital signals, and others. Firmware, software, routines, or instructions may be described herein in terms of specific exemplary aspects and implementations of the disclosure, and performing certain actions.

In some implementations, some or all of the functionalities attributed herein to the system 10 may be provided by external resources not included in the system 10. External resources may include hosts/sources of information, computing, and/or processing and/or other providers of information, computing, and/or processing outside of the system 10.

Although the processor 11 and the electronic storage 13 are shown to be connected to the interface 12 in FIG. 1, any communication medium may be used to facilitate interaction between any components of the system 10. One or more components of the system 10 may communicate with each other through hard-wired communication, wireless communication, or both. For example, one or more components of the system 10 may communicate with each other through a network. For example, the processor 11 may wirelessly communicate with the electronic storage 13. By way of non-limiting example, wireless communication may include one or more of radio communication, Bluetooth communication, Wi-Fi communication, cellular communication, infrared communication, or other wireless communication. Other types of communications are contemplated by the present disclosure.

Although the processor 11 is shown in FIG. 1 as a single entity, this is for illustrative purposes only. In some implementations, the processor 11 may comprise a plurality of processing units. These processing units may be physically located within the same device, or the processor 11 may represent processing functionality of a plurality of devices operating in coordination. The processor 11 may be separate from and/or be part of one or more components of the system 10. The processor 11 may be configured to execute one or more components by software; hardware; firmware; some combination of software, hardware, and/or firmware; and/or other mechanisms for configuring processing capabilities on the processor 11.

It should be appreciated that although computer program components are illustrated in FIG. 1 as being co-located within a single processing unit, one or more of computer program components may be located remotely from the other computer program components. While computer program components are described as performing or being configured to perform operations, computer program components may comprise instructions which may program processor 11 and/or system 10 to perform the operation.

While computer program components are described herein as being implemented via processor 11 through machine-readable instructions 100, this is merely for ease of reference and is not meant to be limiting. In some implementations, one or more functions of computer program components described herein may be implemented via hardware (e.g., dedicated chip, field-programmable gate array) rather than software. One or more functions of computer program components described herein may be software-implemented, hardware-implemented, or software and hardware-implemented The description of the functionality provided by the different computer program components described herein is for illustrative purposes, and is not intended to be limiting, as any of computer program components may provide more or less functionality than is described. For example, one or more of computer program components may be eliminated, and some or all of its functionality may be provided by other computer program components. As another example, processor 11 may be configured to execute one or more additional computer program components that may perform some or all of the functionality attributed to one or more of computer program components described herein.

The electronic storage media of the electronic storage 13 may be provided integrally (i.e., substantially non-removable) with one or more components of the system 10 and/or as removable storage that is connectable to one or more components of the system 10 via, for example, a port (e.g., a USB port, a Firewire port, etc.) or a drive (e.g., a disk drive, etc.). The electronic storage 13 may include one or more of optically readable storage media (e.g., optical disks, etc.), magnetically readable storage media (e.g., magnetic tape, magnetic hard drive, floppy drive, etc.), electrical charge-based storage media (e.g., EPROM, EEPROM, RAM, etc.), solid-state storage media (e.g., flash drive, etc.), and/or other electronically readable storage media. The electronic storage 13 may be a separate component within the system 10, or the electronic storage 13 may be provided integrally with one or more other components of the system 10 (e.g., the processor 11). Although the electronic storage 13 is shown in FIG. 1 as a single entity, this is for illustrative purposes only. In some implementations, the electronic storage 13 may comprise a plurality of storage units. These storage units may be physically located within the same device, or the electronic storage 13 may represent storage functionality of a plurality of devices operating in coordination.

Figure 2:
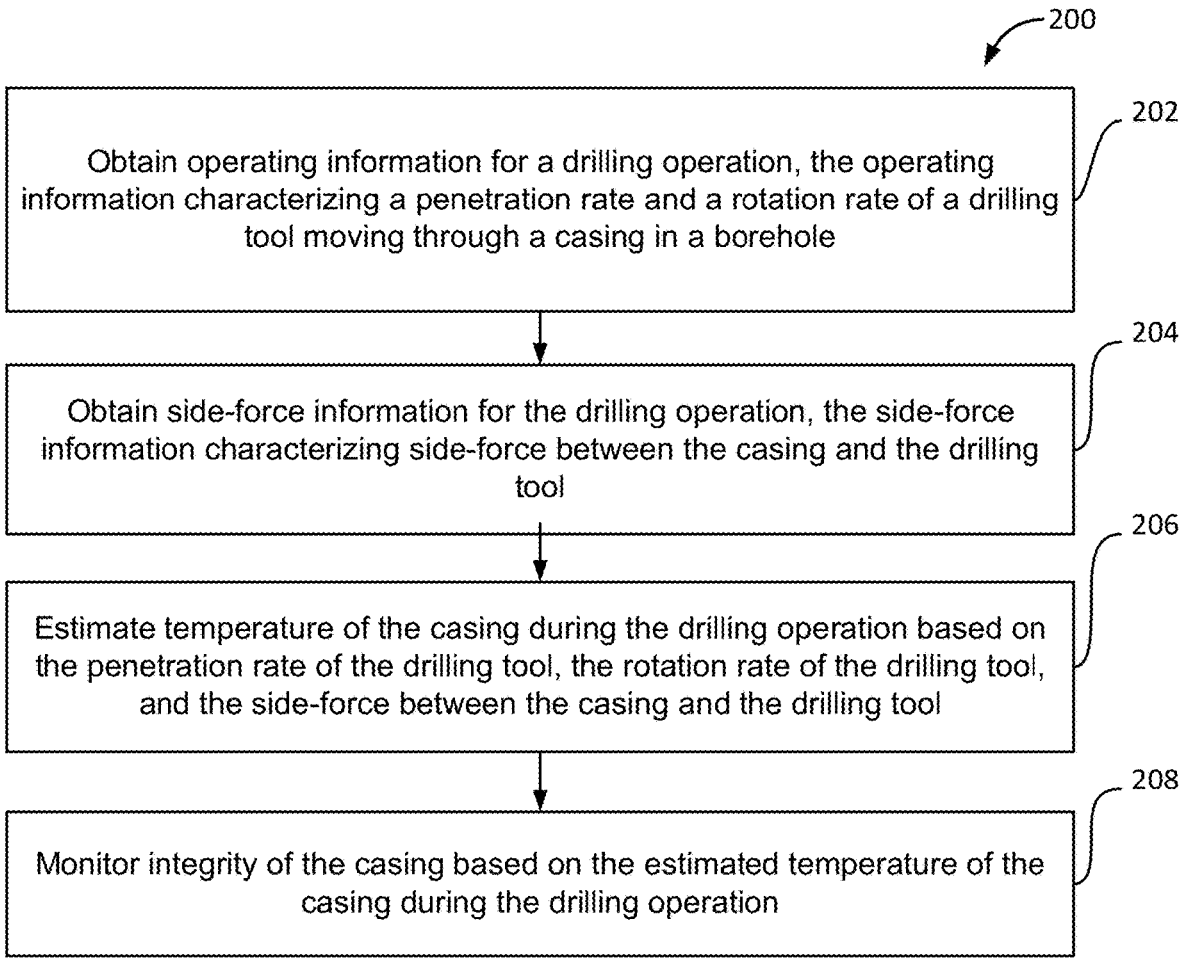
FIG. 2 illustrates an example method for monitoring casings.

FIG. 2 illustrates method 200 for monitoring casings. The operations of method 200 presented below are intended to be illustrative. In some implementations, method 200 may be accomplished with one or more additional operations not described, and/or without one or more of the operations discussed. In some implementations, two or more of the operations may occur substantially simultaneously.

In some implementations, method 200 may be implemented in one or more processing devices (e.g., a digital processor, an analog processor, a digital circuit designed to process information, a central processing unit, a graphics processing unit, a microcontroller, an analog circuit designed to process information, a state machine, and/or other mechanisms for electronically processing information). The one or more processing devices may include one or more devices executing some or all of the operations of method 200 in response to instructions stored electronically on one or more electronic storage media. The one or more processing devices may include one or more devices configured through hardware, firmware, and/or software to be specifically designed for execution of one or more of the operations of method 200.

Referring to FIG. 2 and method 200, at operation 202, operating information for a drilling operation may be obtained. The operating information may characterize a penetration rate and a rotation rate of a drilling tool moving through a casing in a borehole. In some implementation, operation 202 may be performed by a processor component the same as or similar to the operating information component 102 (Shown in FIG. 1 and described herein).

At operation 204, side-force information for the drilling operation may be obtained. The side-force information may characterize side-force between the casing and the drilling tool. In some implementation, operation 204 may be performed by a processor component the same as or similar to the side-force information component 104 (Shown in FIG. 1 and described herein).

At operation 206, temperature of the casing during the drilling operation may be estimated based on the penetration rate of the drilling tool, the rotation rate of the drilling tool, and the side-force between the casing and the drilling tool. In some implementation, operation 206 may be performed by a processor component the same as or similar to the temperature component 106 (Shown in FIG. 1 and described herein).

At operation 208, integrity of the casing may be monitored based on the estimated temperature of the casing during the drilling operation. In some implementation, operation 208 may be performed by a processor component the same as or similar to the integrity component 108 (Shown in FIG. 1 and described herein).

Although the system(s) and/or method(s) of this disclosure have been described in detail for the purpose of illustration based on what is currently considered to be the most practical and preferred implementations, it is to be understood that such detail is solely for that purpose and that the disclosure is not limited to the disclosed implementations, but, on the contrary, is intended to cover modifications and equivalent arrangements that are within the spirit and scope of the appended claims. For example, it is to be understood that the present disclosure contemplates that, to the extent possible, one or more features of any implementation can be combined with one or more features of any other implementation.

What is claimed is:

1. A system for monitoring casings, the system comprising:

one or more physical processors configured by machine-readable instructions to:

obtain operating information for a drilling operation, the operating information characterizing a penetration rate of a drilling tool and a rotation rate of the drilling tool, the drilling tool moving through a casing in a borehole;

obtain side-force information for the drilling operation, the side-force information characterizing side-force between the casing and the drilling tool;

estimate temperature of the casing during the drilling operation based on the penetration rate of the drilling tool, the rotation rate of the drilling tool, and the side-force between the casing and the drilling tool; and monitor integrity of the casing based on the estimated temperature of the casing during the drilling operation.

2. The system of claim 1, wherein the drilling tool includes a drill pipe, contact between the casing and the drill pipe causing the side-force between the casing and the drill pipe.

3. The system of claim 2, wherein the contact between the casing and the drill pipe includes contact between the casing and a joint of the drill pipe and/or a tube of the drill pipe.

4. The system of claim 1, wherein monitoring the integrity of the casing based on the estimated temperature of the casing during the drilling operation includes determining whether the estimated temperature of the casing during the drilling operation is above or below steel austenitizing temperature.

5. The system of claim 1, wherein monitoring the integrity of the casing based on the estimated temperature of the casing during the drilling operation includes determining a number of heat check cycles based on the estimated temperature of the casing during the drilling operation.

6. The system of claim 5, wherein the heat check cycle quantifies an extent to which the casing experienced above-austenitizing temperature during the drilling operation.

7. The system of claim 6, wherein monitoring the integrity of the casing based on the estimated temperature of the casing during the drilling operation further includes providing a real-time monitoring interface that visually provides information on the number of heat check cycle.

8. The system of claim 7, wherein the real-time monitoring interface includes heat check cycle markers that visually represent individual occurrences of the casing experiencing the above-austenitizing temperature during the drilling operation.

9. The system of claim 8, wherein the real-time monitoring interface further includes a cumulative indicator that visually represents accumulation of the occurrences of the casing experiencing the above-austenitizing temperature during the drilling operation.

10. The system of claim 9, wherein the real-time monitoring interface visually provides information on the estimated temperature of the casing, steel austenitizing temperature, and the side force.

11. A method for monitoring casings, the method comprising:

obtaining operating information for a drilling operation, the operating information characterizing a penetration rate of a drilling tool and a rotation rate of the drilling tool, the drilling tool moving through a casing in a borehole;

obtaining side-force information for the drilling operation, the side-force information characterizing side-force between the casing and the drilling tool;

estimating temperature of the casing during the drilling operation based on the penetration rate of the drilling tool, the rotation rate of the drilling tool, and the side-force between the casing and the drilling tool; and monitoring integrity of the casing based on the estimated temperature of the casing during the drilling operation.

12. The method of claim 11, wherein the drilling tool includes a drill pipe, contact between the casing and the drill pipe causing the side-force between the casing and the drill pipe.

13. The method of claim 12, wherein the contact between the casing and the drill pipe includes contact between the casing and a joint of the drill pipe and/or a tube of the drill pipe.

14. The method of claim 11, wherein monitoring the integrity of the casing based on the estimated temperature of the casing during the drilling operation includes determining whether the estimated temperature of the casing during the drilling operation is above or below steel austenitizing temperature.

15. The method of claim 11, wherein monitoring the integrity of the casing based on the estimated temperature of the casing during the drilling operation includes determining a number of heat check cycles based on the estimated temperature of the casing during the drilling operation.

16. The method of claim 15, wherein the heat check cycle quantifies an extent to which the casing experienced above-austenitizing temperature during the drilling operation.

17. The method of claim 16, wherein monitoring the integrity of the casing based on the estimated temperature of the casing during the drilling operation further includes providing a real-time monitoring interface that visually provides information on the number of heat check cycle.

18. The method of claim 17, wherein the real-time monitoring interface includes heat check cycle markers that visually represent individual occurrences of the casing experiencing the above-austenitizing temperature during the drilling operation.

19. The method of claim 18, wherein the real-time monitoring interface further includes a cumulative indicator that visually represents accumulation of the occurrences of the casing experiencing the above-austenitizing temperature during the drilling operation.

20. The method of claim 19, wherein the real-time monitoring interface visually provides information on the estimated temperature of the casing, steel austenitizing temperature, and the side force.

* * * * *